US005892485A

United States Patent [19]

Glabe et al.

[11] Patent Number: 5,892,485

[45] Date of Patent: Apr. 6, 1999

[54] DUAL FREQUENCY REFLECTOR ANTENNA FEED ELEMENT

[75] Inventors: John Glabe, Ramona; Francis D. McGaffigan, Escondido, both of Calif.

[73] Assignee: Pacific Antenna Technologies, San Diego, Calif.

[21] Appl. No.: 804,637

[22] Filed: Feb. 25, 1997

[51] Int. Cl.[6] ..... H01Q 1/42

[52] U.S. Cl. ..... 343/789; 343/840; 343/756; 343/909

[58] Field of Search ..... 343/756, 789, 343/797, 801, 821, 909

[56] References Cited

U.S. PATENT DOCUMENTS

| | | | |
|---|---|---|---|
| 3,740,754 | 6/1973 | Epis | 343/789 |
| 4,183,027 | 1/1980 | Ehrenspeck | 343/726 |
| 4,668,956 | 5/1987 | Mahnad | 343/789 |
| 4,970,634 | 11/1990 | Howell et al. | 343/909 |
| 5,384,575 | 1/1995 | Wu | 343/909 |
| 5,455,594 | 10/1995 | Blashing et al. | 343/909 |
| 5,481,272 | 1/1996 | Yarsunas | 343/789 |
| 5,528,249 | 6/1996 | Grafford et al. | 343/909 |

*Primary Examiner*—Don Wong
*Assistant Examiner*—Tan Ho
*Attorney, Agent, or Firm*—John J. Murphey

[57] ABSTRACT

A dual frequency feed element for a parabolic reflector antenna system, comprising a conductive cavity having a central axis, the cavity mounted at the focal point of a parabolic reflector surface and defined about its outer perimeter by an upstanding cavity wall, and having a closed cavity floor and an open top directed toward the reflective surface, a dual frequency radiating element centrally disposed in the cavity and arranged to radiate a first low frequency signal out through the cavity open top to the antenna surface, a conductive floor fixed below the radiating element a distance in relation to the radiant energy for the first low frequency signal, and disposed in the cavity transverse to the central axis thereof to reflect radiant energy for the first signal and, a frequency selective surface fixed below the radiating element, apart from the conductive floor, and transverse to the central axis of the cavity to reflect radiant energy for the second, higher frequency signal while simultaneously being invisible to the lower frequency signal.

19 Claims, 4 Drawing Sheets

DUAL FREQUENCY REFLECTOR ANTENNA FEED ELEMENT

BACKGROUND OF THE INVENTION

1. Field of the Invention

This invention pertains to the field of microwave antennas. More particularly, this invention pertains to a dual frequency reflector feed element for parabolic antennas that simultaneously operates in two separate frequency ranges such as the C-band and the Ku-band.

2. Description of the Prior Art

It is well-known in the field of antennas that the feed element for a reflector-type antenna must provide a radiation pattern that properly illuminates the reflector. In particular, the peak of the illuminating pattern is ordinarily directed at the center of the reflector and the amplitude of the pattern falls off with angle such that the amplitude directed toward the edge of the reflector is approximately 10 dB below the peak amplitude at the center of the reflector. This results in what is commonly regarded as an optimum radiation pattern for the reflector antenna in terms of gain, beam width and side lobe level.

A uniform illumination would result in a narrower beam width but also in unwanted higher side lobe levels. The higher side lobe levels increase the noise figure of the antenna system which degrades performance. A greater amplitude taper, such that the amplitude directed toward the edge of the reflector being more than 10 dB below the peak amplitude directed at the center of the reflector, will reduce side lobe levels but increase beam width and reduce gain in the antenna. The reduction in gain also has the effect of increasing the noise figure of the whole antenna system. Other non-uniform illumination patterns generally result in reduced gain and/or increased side lobe levels with the consequent reduction in overall system sensitivity.

Since the most common reflector configuration is circular, the E-plane and H-plane radiation patterns of the feed must be of very nearly the same beam width. A common feed element utilizes a dipole element which has an omnidirectional H-plane pattern. In order to provide a proper illuminating pattern, the dipole is mounted in front of a conductive cavity and located approximately 0.25 wavelengths ($\lambda$) above the conductive floor of the cavity. When thus configured the cavity constrains the feed element radiation to the correct direction with respect to the reflector.

The spacing between the dipole antenna and the floor of the cavity results in the reflection of radiated energy in the direction of the reflector such that the reflected radiation is in phase with the direct radiation and adds constructively, resulting in an increase in gain of the feed of about 3 dB. This is highly desirable since it improves the efficiency and sensitivity of the whole system. However, if the cavity is 0.25 wavelengths deep at the lowest frequency band, the radiation patterns at the high band will be poorly shaped and lobey because the energy reflected from the cavity floor will generally not be in phase with the direct radiation and system gain will be reduced at the high band. Similarly, if the cavity is 0.25 wavelengths deep at the high frequency band the radiation patterns at the low frequency band will be degraded with a consequent reduction in system gain at the low band.

In the area of direct broadcast via satellite of television signals to homes, it is desirable for the satellite receiving antenna to receive efficiently at two distinct bands since the satellites that broadcast television signals transmit at two different frequency bands. The bands are presently identified as "C-Band" which consists of signals transmitted at a frequency between 3.7 GHz and 4.2 GHz, and "Ku-Band" which consists of signals transmitted at a frequency between about 10.6 GHz and 12.7 GHz.

In the present state of the art, symbolized by patents such as U.S. Pat. Nos. 4,740,795; 4,872,211; 4,903,037; 5,066,958; 5,107,274; and, 5,255,003, feeds with the capability of receiving both C-Band and Ku-Band signals typically consist of two separate antennas merged into a single complex and consequently expensive assembly. In a common design, the low band antenna consists of an open ended wave guide or cavity with a probe near the bottom thereof that picks up the received signal and conducts it to another section of the wave guide which conveys the signal to an integral low noise amplifier and down converter. The high band antenna is a yagi-type antenna consisting of a dipole, a corner reflector behind the dipole and a passive dipole in front of the dipole. This high frequency antenna is mounted in the mouth of the low band wave guide and the coaxial cable from the high band dipole is lead down through the wave guide along its centerline and through the floor to a third wave guide which conveys the high band signal to a second low noise amplifier and down converter.

Accordingly, there is a need in the art for a simple, inexpensive feed element that properly illuminates a reflector at two separate frequency bands such that optimum system performance is achieved at both bands.

SUMMARY OF THE INVENTION

The present invention is a dual frequency feed element that provides proper illumination of a reflector antenna at two different frequency bands. The antenna comprises a dual frequency radiating element for location at the focal point of a parabolic reflector antenna disposed at the front of a conducting cavity such that the radiating element is approximately 0.25 $\lambda$ above the conductive floor of the cavity at the middle of the low frequency band. Proper radiation patterns at the high frequency band are provided by the inclusion of a frequency selective surface (FSS) positioned transverse to the cavity and 0.25 $\lambda$ below the radiating element. This frequency selective surface functions as a reflective ground plane for radiation at the high frequency band but is transparent at the low frequency band and thus does not affect the low band patterns. This construction provides a cavity that is effectively 0.25 $\lambda$ deep at two distinct frequencies which is the ideal in terms of antenna efficiency.

Accordingly, the main object of this invention is a means of providing optimum system performance at both frequency bands of a dual frequency feed antenna for a parabolic reflector. Other objects of the invention include a means of increasing the efficiency of a dual frequency feed antenna so that operation in one frequency band does not adversely affect the performance of the antenna feed in the other frequency band; a dual frequency feed antenna that maximizes antenna performance in two separate frequency bands, such as the C-Band and the Ku-Band, without one frequency operation interfering with the other frequency operation; a feed system that is retro-fittable on existing parabolic antennae to improve the operation of the antenna at two different frequencies; and, a feed system constructed of few parts and ruggedly built that will easily withstand the rigors of outdoor activity.

These and other objects of the invention will become more apparent upon reading the following description of the preferred embodiment taken together with the drawings appended hereto. The scope of protection sought by the inventors may be gleaned from a fair reading of the Claims that conclude this Specification.

DESCRIPTION OF THE PREFERRED EMBODIMENTS

Figure 1:
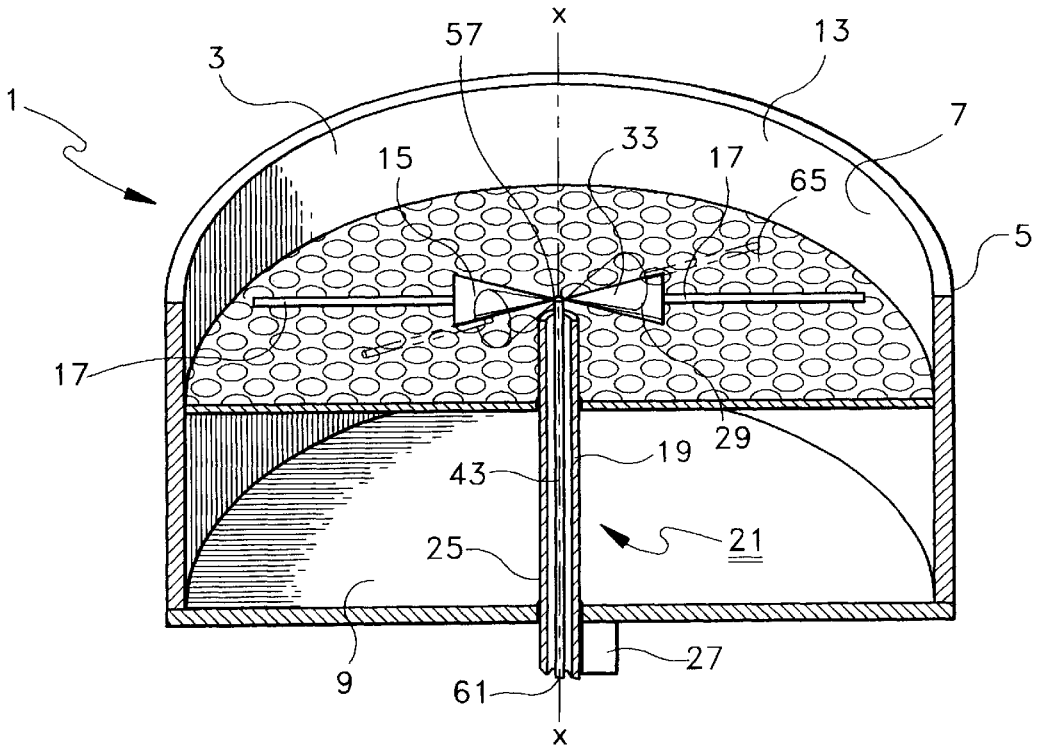
FIG. 1 is an illustrative view, partly in section, of the preferred embodiment of this invention.
Figure 6:
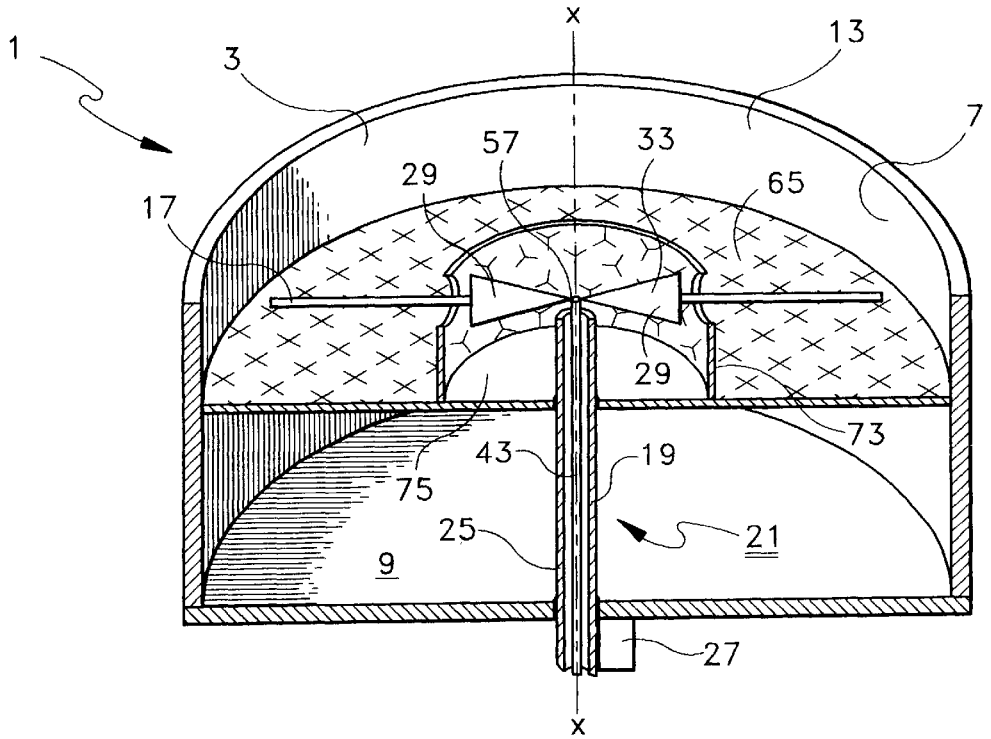
FIG. 6 is an illustrative view of another embodiment of the invention permitting independent control of the beam width of the high band radiation pattern; and, FIG. 7 is an illustrative view of still another embodiment of the invention showing utilization of the frequency selective surfaces in other parts of the antenna assembly.
Figure 5:
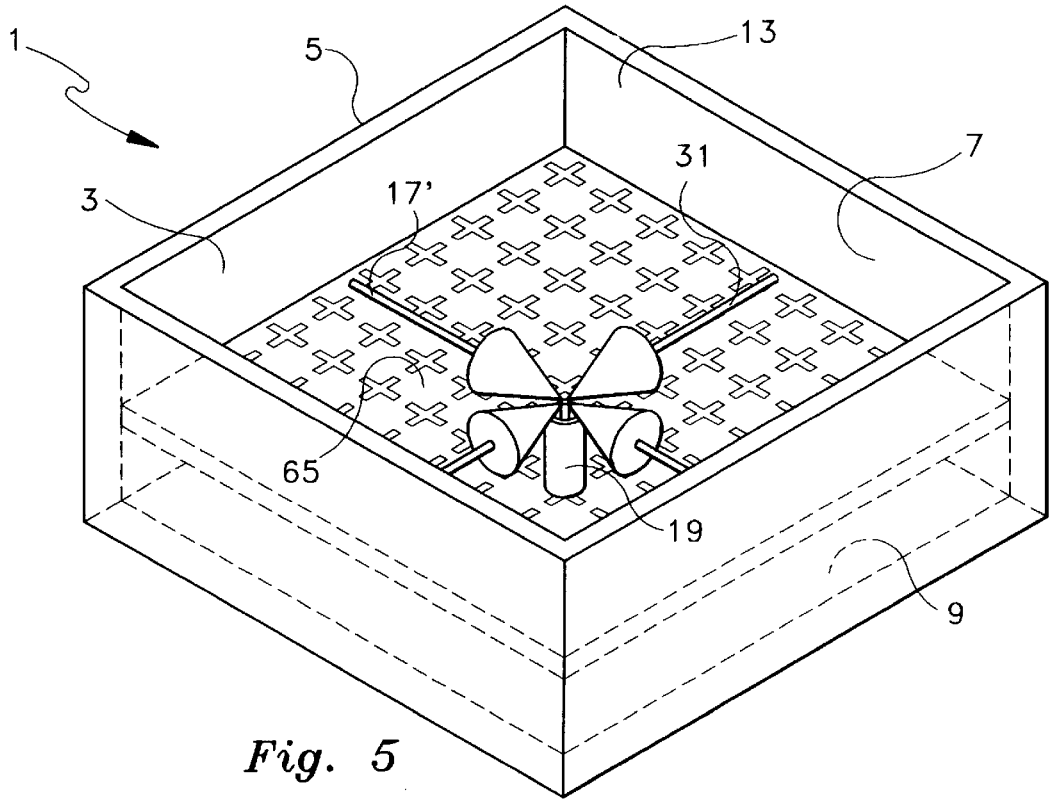
FIG. 5 is an illustrative view of another embodiment of the invention providing dual orthogonal linear or dual circular polarizations.

Turning now to the drawings, where like elements are identified with like numerals throughout the seven figures, FIG. 1 shows the preferred embodiment of this invention and shows a dual frequency feed element for mounting at the focal point of and facing the parabolic reflector of a reflector antenna system, generally shown at 1, that comprises a conductive cavity 3 defined about its outer perimeter 5 by an upstanding cavity wall 7, a closed cavity floor 9 and having an open top 13. Cavity 3 can be formed in a wide variety of shapes such as cylindrical, as shown in FIGS. 1 and 6, or square, as shown in FIG. 5. Triangular, pentagonal, octagonal, and other geometric shapes are useful herein and all are contemplated in this invention.

Located in the center of cavity 3 and aligned along the central axis x—x thereof is a single element, dual frequency dipole antenna 15 of the type disclosed and claimed in our co-pending patent application titled "SINGLE-ELEMENT, MULTI-FREQUENCY, DIPOLE ANTENNA" Ser. No. 08/738,459, filed Oct. 30, 1996 which is a Continuation-In-Part of our parent patent application titled "SINGLE-ELEMENT, MULTI-FREQUENCY, DIPOLE ANTENNA" Ser. No. 08/607,185, filed Feb. 26, 1996 now abandoned and, in particular, of the type shown in FIG. 10 thereof.

Figure 2:
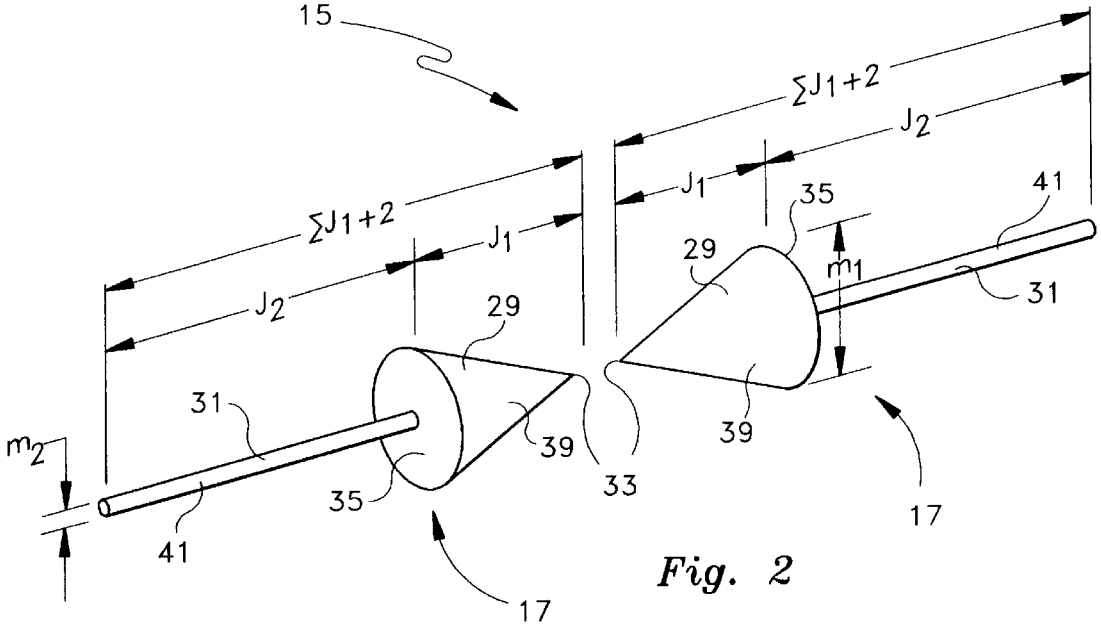
FIG. 2 is an illustrative view of the preferred embodiment of the dual frequency dipole antenna useful in this invention.

Antenna 15 is shown in FIG. 2 and described in more particularity as a dipole antenna installation comprising two substantially equal arm sections 17 of conductive material extending co-axially in a straight line in opposite directions from each other from a central support mast or shield 19, having means 21, including an outer tube 25, for mounting said mast in cavity floor 9. Antenna 15 is located at the focal point of a parabolic TV (dish) reflector antenna and is directed toward the reflector. The reflector is not shown. A motorized drive unit 27 is provided, under cavity floor 9, to rotate antenna 15 from one position to another, shown in dotted outline, and back again so that antenna 15 can receive polarized radiation from two directions.

Dipole arms 17 are shown to comprise a pair of cones 29 and stems 31 with the apexes 39 of the cones directed toward each other and their bases 35 facing outward. Said cones 29 and stems 31 include sub-sections 39 of $j_1$ length and subsections 41 of $j_2$ length respectively. The discontinuity in arms 17 is made by the change in the diameter of cone base ($m_1$) to stem diameter ($m_2$). Here, the widths "$m_1$" and "$m_2$" of sub-sections $j_1$ and $j_2 \ldots j_n$ may be equal or unequal. Each apex 33 is attached to a balun 43. The length of cone 29 is selected to assure operation at the desired high frequency and the overall length, $j_1$ and $j_2$, is adjusted to operated at the desired low frequency. The same description of the invention holds true, however, that a consecutive-integer sequence of j sub-sections will resonate at about ¼ the wavelength of a frequency lower than the individual sub-sections themselves and one must always include $j_1$ in the sequence. Other dual band radiating elements may be employed or a wide band radiating element may alternatively be employed.

It is common in the antenna field to refer to an antenna as "radiating" even though it is likewise capable of "receiving" the same sort of radiation. In fact, the same radiation pattern (lobes) occur when the antenna is in the "receiving" mode. Accordingly, when used in this patent application, the term "radiating" is to mean "radiating" and "receiving." Dipole antenna 15 receives the satellite radiation reflected from various parts of the parabolic reflector, or dish, and passes it down balun 43 to a processing unit for introduction into a cable leading to a television set. Balun is the term given to a short piece of transmission line that matches the impedance (resistance) of the antenna and which transforms from an unbalanced transmission line, such as coaxial cable, to a balanced transmission line, such as twin lead transmission line, that feeds the dipole. The various television satellites separate their channels by polarizing the odd and even channels orthogonal (perpendicular) to each other.

The preferred embodiment of balun 43 used in this invention is a strip of pliable material that allows rotation without the use of a rotary joint coupling, used in the prior art, so that, not only is the incoming signal not degraded, but the normal amount of electrical mismatch, caused by the rotary joint coupling, is eliminated so that the "net" signal is far stronger.

Figure 3A:
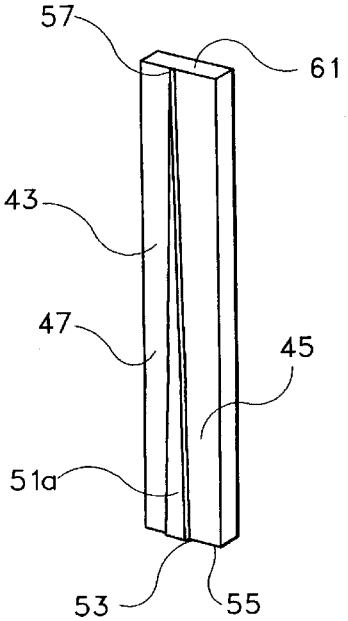
FIGS. 3*a* and 3*b* are illustrative views of the opposite sides of a balun that is useful in this invention.
Figure 3B:
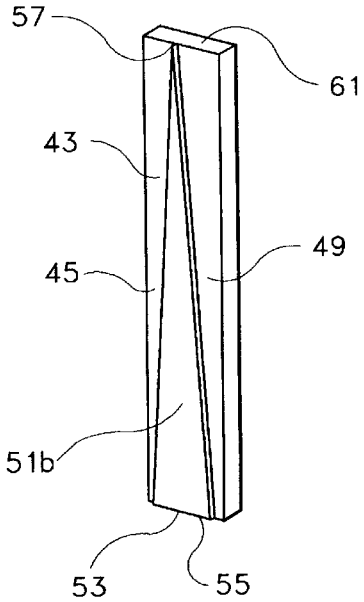

Turning to FIGS. 3*a* and 3*b*, it can be seen that balun 43 comprises a strip 45 of dielectric material, such as thin, 3–5 mils thick, strip of polyimide or Teflon®, having smooth flat opposed surfaces 47 and 49. On these surfaces are deposited conductive strips 51*a* and 51*b* of metallic material forming a ground plane 53 on surface 49 at one end 55 of strip 45 and both halves of a twin lead conductor 57 on opposite surfaces 47 and 49 at the opposite end 61 of strip 45. Balun 43 is then positioned inside shield 19 as shown in FIG. 1 and each end 55 and 61 connected, as known in the prior art, namely twin lead conductors 57 connected to cone apexes 33 and ground plane conductors 53 connected to a diplexer (not shown) that processes the signals and separates one signal, such as the C-Band signal, from the other signal, such as from the Ku-band signal, for further processing.

The unique feature of balun 43 is that there is no need to provide a slip coupling with its attendant signal loss and noise generation. Balun 43 is merely allowed to wind around inside shield 19 as antenna arms 17 are rotated into alignment with the appropriate polarization angle of the radiation. Balun 43 can tolerate the forward and reverse rotation of dipole arms 17 without losing any of the incoming signal and without generating any noise whatsoever. The end result is a significant increase in the "net" signal passed onto to the diplexer.

Cavity floor 9 is disposed below antenna dipole arms 17 a distance of approximately 0.25 λ at the middle of the first or low frequency band and transverse to cavity 3 as shown in FIG. 1. In the case of the low frequency C-Band, 0.25 λ is a distance of about one inch. The spacing between dipole antenna 15 and cavity floor 9 results in the reflection, or receipt, of radiated energy in the direction of the reflector such that the reflected radiation is in phase with the direct radiation and adds constructively, resulting in an increase in gain of the feed of about 3 dB. This is highly desirable since it improves the efficiency and sensitivity of the whole system.

A frequency selective surface (FSS) 65 is located below antenna 15 and above cavity floor 9 to act as a reflective surface for the second or higher frequency band. Because of its unique design, the FSS also is invisible to low frequency radiation and does not interfere with the action of cavity floor 9 radiating the first or lower frequency radiation. FSS 65 is also located transverse to cavity main axis x—x and is preferably located 0.25 λ below antenna dipole arms 17. In the case of the high frequency Ku-Band, 0.25 λ is a distance of about one-quarter of an inch.

Figure 4:
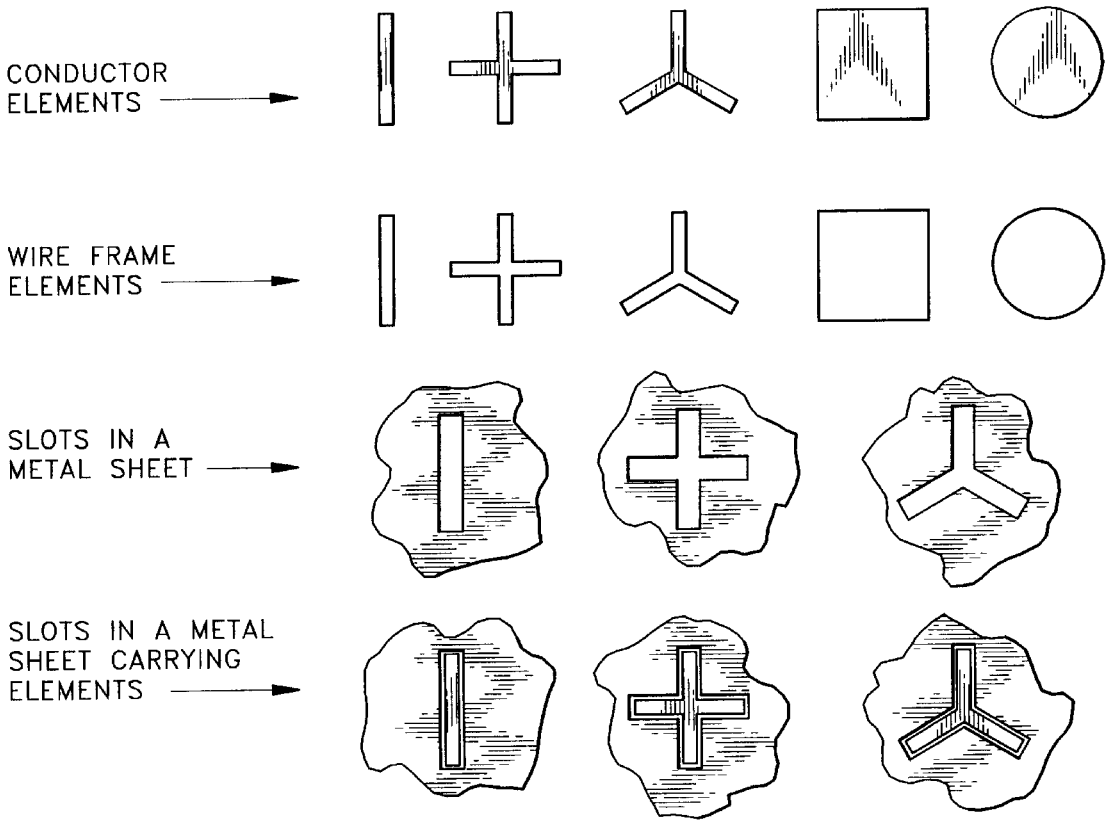
FIG. 4 are illustrative views of four types of elements that can be arrayed to form frequency selective surfaces (FSS)

FIG. 4 shows various types of frequency selective surfaces usable in this invention. The line of elements labeled "conductor elements" are in the form of short straight line segments, crosses, Y-shaped, square and round elements made of metal, metal wire, or metal foil such as copper foil. The line of elements labeled "wire frame elements" are preferably elements made out of thin metal wire or metal foil. The line of elements labeled "slots in a metal sheet" are preferably elements cut out of a foil covered dielectric substrate, such as Kapton® or Teflon®, both products of DuPont Chemical Co. The line of elements labeled "slots in a metal sheet carrying elements" are preferably made by first cutting the slot, cross, or Y-shaped opening in a foil, such as copper foil, then mounting the foil on a dielectric sheet, and then placing elements of the same size and shape, also made from foil, in the openings. The size and shape of the elements will depend upon the frequency ranges to be reflected and to the frequency ranges to which the FSS is to be invisible.

FIG. 5 shows the same embodiment as shown in FIG. 1 except that a different FSS surface 65 is used and antenna 15 provides dual orthogonal linear or dual circular polarizations by having a second set of dipole arms 17' arranged at right angles to first set of dipole arms 17. In this embodiment, dipole antenna 15 need not be rotated in order to receive signals.

FIG. 6 shows an alternate embodiment of the invention wherein a wall or collar 73 of a frequency selective surface 65' is placed about the high frequency elements of antenna 15 and above transversely mounted frequency selective surface 65. In this embodiment, collar 73 forms a smaller, high frequency band cavity 75 in order to independently control the pattern and beam width of the high frequency band while, at the same time, being invisible to the low frequency band. In this embodiment, the selection of the appropriate FSS to be conductive in one frequency band and invisible in another frequency band is within the skill of the prior art.

Figure 7:
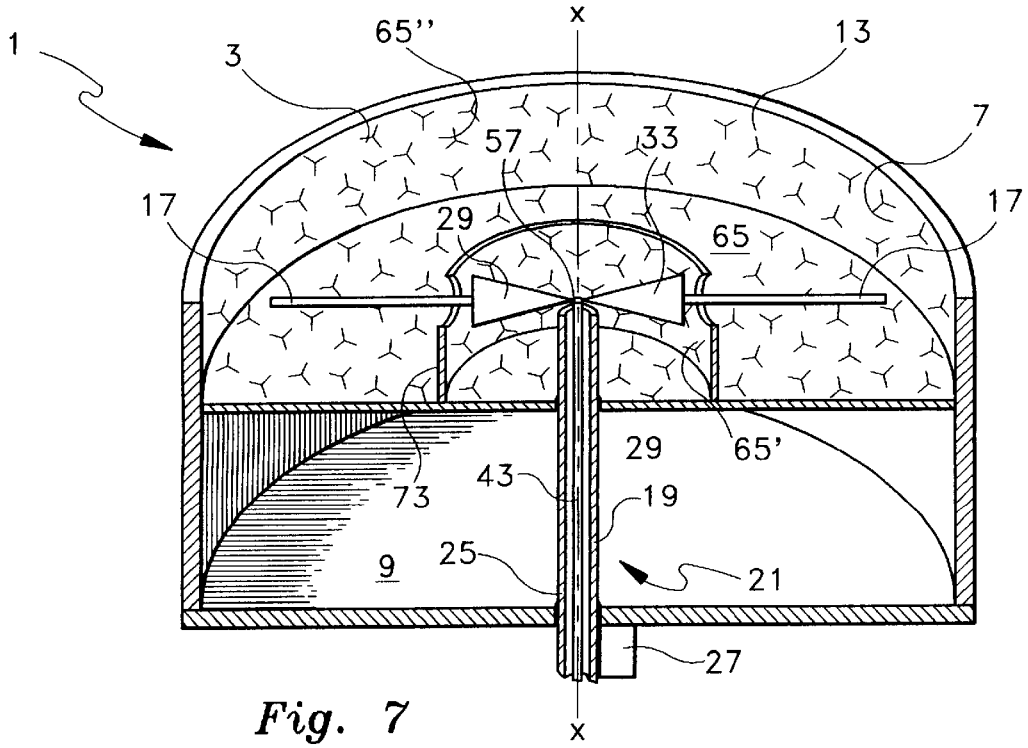

FIG. 7 shows still another embodiment of the invention wherein, like that shown in FIG. 6, both a wall or collar 73 of a frequency selective surface 65' is placed about the arms 17 of antenna 15, above transverse frequency selective surface 65, and in combination therewith, and cavity wall 7, above FSS 65' is also made in a frequency selective surface 65". In this embodiment, frequency selective surface 65" is chosen so that it will be transparent at the high band frequency and conductive at the low band frequency. This is opposite to FSS 65 that is used in the transverse position above cavity floor 9.

While the invention has been described with reference to a particular embodiment thereof, those skilled in the art will be able to make various modifications to the described embodiment of the invention without departing from the true spirit and scope thereof. It is intended that all combinations of members and steps which perform substantially the same function in substantially the way to achieve substantially the same result are within the scope of this invention.

What is claimed is:

1. A dual frequency feed element for a parabolic reflector antenna system, comprising:

a) a conductive cavity having a central axis, said cavity for mounting at the focal point of a parabolic reflector surface and defined about its outer perimeter by an upstanding conductive cavity wall, and having a closed conductive cavity floor and an open top for directing toward the reflector surface;

b) a single dual frequency radiating element centrally disposed in said cavity and arranged to radiate a first low frequency signal and a second, higher frequency signal out through said cavity open top to the antenna surface;

c) said conductive floor fixed below said radiating element a distance in relation to the radiant energy for said first low frequency signal, and disposed in said cavity transverse to said central axis to reflect radiant energy for said first signal; and, d) a frequency selective surface fixed below said radiating element, apart from said conductive cavity floor, and transverse to said central axis of said cavity to reflect radiant energy for said second, higher frequency signal while simultaneously being invisible to said low frequency signal.

2. The dual frequency feed element for a reflector antenna system of claim 1 wherein said cavity is cylindrical in shape.

3. The dual frequency feed element for a reflector antenna system of claim 1 wherein said cavity is square in shape.

4. The dual frequency feed element for a reflector antenna system of claim 1 wherein said conductive floor is fixed transverse to said central axis of said cavity.

5. The dual frequency feed element for a reflector antenna system of claim 1 wherein said conductive cavity floor is fixed transverse to said central axis of said cavity and at a distance below said radiating element representing one-quarter of the wave length of the central frequency of the band wherein said first low frequency signal is located.

6. The dual frequency feed element for a reflector antenna system of claim 1 wherein said frequency selective surface is fixed transverse to said central axis of said cavity and at a distance below said radiating element representing one-quarter of the wave length of the central frequency of the band wherein said second high frequency signal is located.

7. The dual frequency feed element for a reflector antenna system of claim 1 wherein said single, dual frequency radiating element is a dual frequency dipole antenna.

8. The dual frequency feed element for a reflector antenna system of claim 1 wherein said single, dual frequency radiating element comprises a single element, multi-frequency dipole antenna including two substantially equal arm sections of conductive material extending co-axially in a straight line in opposite directions from each other, one said arm section being a mirror image of said other arm section throughout its entire length, each said arm section comprising at least two contiguous shorter sub-sections of $j_1, j_2, \ldots j_n$ lengths, wherein $j_1$ represents the length of the innermost sub-section and has a diameter of $m_1$, wherein $j_2$ represents the length of the innermost sub-section and has a diameter of $m_2$, and wherein $j_n$ represents the length of the innermost sub-section and has a diameter of $m_n$, said sub-sections terminated by discontinuities wherein $j_1$ represents the ¼ wavelength of the highest resonant frequency and each consecutive-integer sequence of j sub-sections represent the ¼ wavelength of lower resonant frequencies.

9. The single element, multi-frequency dipole antenna of claim 8 wherein said antenna is three-dimensional, said discontinuities are abrupt changes in diameters $m_1, m_2, \ldots m_n$ of said subsections and $m_1 \neq m_2 \neq \ldots m_n$.

10. The single element, multi-frequency dipole antenna of claim 8 wherein $m_1 > m_2 > \ldots m_n$.

11. The single element, multi-frequency dipole antenna of claim 8 wherein $m_1 < m_2 < \ldots m_n$.

12. The single element, multi-frequency dipole antenna of claim 8, comprising:

a) two substantially equal arm sections of conductive material extending co-axially in a straight line in opposite directions from each other;

b) each said arm section being a mirror image of said other arm section; and, c) said arm sections including two inner cone-shaped elements with their apexes directed toward each other, said apexes for connection to a common balun, each said arm section further comprising a series of contiguous sub-sections of $j_1, j_2, j_3, \ldots j_n$ lengths and of $m_1, m_2, m_3, \ldots m_n$ cross-sectional areas respectively, each sub-section separated from the adjacent sub-section by a discontinuity and wherein $j_1$ represents said innermost sub-section and each consecutive-integer sequence of j sub-sections, such as $\Sigma(j_1+j_2)$, $\Sigma(j_1+j_2+j_3)$, and $\Sigma(j_1+j_2+j_3+j_4 \ldots j_n)$, represent the ¼ wavelength of lower resonant frequencies.

13. The dual frequency feed element for a reflector antenna system of claim 1 further including a connector for said dual frequency radiating element comprising:

a) an elongated strip of flexible dielectric substrate having spaced-apart terminal ends for connecting respectively to a rotatable dipole antenna and to diplexer means;

b) said strip of a length allowing bending thereof as the antenna is rotated through 90°;

c) said strip further defined by first and second opposite surfaces in space-apart relation and in contact with said strip ends, said first surface containing a patterned first metalization strip ground plane and spaced-apart conductor and said second surface containing a patterned second metalization ground plane and spaced-apart conductor, said first and second surfaces forming a balun.

14. The dual frequency feed element for a reflector antenna system of claim 1 wherein the a frequency selective surface includes conductor elements selected from the group consisting of straight line segments, crosses, Y-shaped, square and round elements made of metal, metal wire, or metal foil such as copper foil.

15. The dual frequency feed element for a reflector antenna system of claim 1 wherein the a frequency selective surface includes conductor elements selected from the group consisting of straight line segments, crosses, Y-shaped, square and round elements cut out of a foil covered dielectric substrate.

16. The dual frequency feed element for a reflector antenna system of claim 1 wherein the a frequency selective surface includes conductor elements selected from the group consisting of first cutting the slot, cross, or Y-shaped opening in a foil, such as copper foil, then mounting the foil on a dielectric sheet, and then placing elements of the same size and shape, also made from foil, in the openings.

17. The dual frequency feed element for a reflector antenna system of claim 1 wherein said dual frequency radiating element is a dual frequency dipole antenna and further including a frequency selective collar surrounding said antenna, inboard of said cavity wall, to further shape the radiation passing between said cavity and the reflector surface.

18. A dual frequency feed element for a parabolic reflector antenna system, comprising:

a) a conductive cavity having a central axis, said cavity mounted at the focal point of a parabolic reflector surface and defined by its outer perimeter by an upstanding cavity wall and having a closed conductive cavity floor and an open top that is directed toward the reflector surface;

b) a single dual frequency radiating element centrally disposed in said cavity and arranged to radiate a first low frequency signal and a second, higher frequency signal out through said cavity open top to the antenna surface;

c) a conductive cavity floor fixed below said radiating element a distance in relation to the radiant energy for said first low frequency signal, and disposed in said cavity transverse to said central axis thereof to reflect radiant energy for said first signal;

d) a first frequency selective surface fixed below said radiating element, apart from said conductive cavity floor, and transverse to said central axis of said cavity to reflect radiant energy for said second, higher frequency signal while simultaneously being invisible to said lower frequency; and, e) a second frequency selective surface, forming an upstanding cavity wall above said first frequency selective surface, surrounding said radiating element and interior said cavity wall, invisible to said second high frequency signal and conductive to said first low frequency signal.

19. A dual frequency feed element for aparabolic reflector antenna system, comprising:

a) a conductive cavity having a central axis, said cavity mounted at the focal point of a parabolic reflector surface and defined by an outer perimeter and having a closed, conductive cavity floor and an open top that is directed toward the reflector surface;

b) a single, dual frequency radiating element centrally disposed in said cavity and arranged to radiate a first low frequency signal and a second, higher frequency signal out through said cavity open top to the antenna surface;

c) said cavity floor fixed below said radiating element a distance in relation to the radiant energy for said first low frequency signal, and disposed in said cavity transverse to said central axis thereof to reflect radiant energy for said first signal;

d) a first frequency selective surface fixed below said radiating element, apart from said conductive cavity floor, and transverse to said central axis of said cavity to reflect radiant energy for said second, higher frequency signal while simultaneously being invisible to said lower frequency;

e) a second frequency selective surface, forming an upstanding wall above said first frequency selective surface, surrounding said radiating element and interior of said outer cavity perimeter, invisible to said second high frequency signal and conductive to said first low frequency signal;

f) a third frequency selective surface, forming the cavity wall extending between said cavity perimeter and said first frequency selective surface, invisible to said second high frequency signal and conductive to said first low frequency signal; and g) a conductive cavity wall extending between said third frequency selective surface and said first frequency selective surface.

* * * * *